US011980333B1

(12) United States Patent
Mathieu

(10) Patent No.: US 11,980,333 B1
(45) Date of Patent: May 14, 2024

(54) AUTOMATIC SHOE-SHINING DEVICE

(71) Applicant: Jerry Mathieu, Brooklyn, NY (US)

(72) Inventor: Jerry Mathieu, Brooklyn, NY (US)

( * ) Notice: Subject to any disclaimer, the term of this patent is extended or adjusted under 35 U.S.C. 154(b) by 463 days.

(21) Appl. No.: 17/361,426

(22) Filed: Jun. 29, 2021

(51) Int. Cl.
*A47L 23/02* (2006.01)
*A47L 23/04* (2006.01)
*A47L 23/18* (2006.01)

(52) U.S. Cl.
CPC ..... *A47L 23/02* (2013.01); *A47L 23/04* (2013.01); *A47L 23/18* (2013.01)

(58) Field of Classification Search
CPC ..... A47L 23/00; A47L 23/02; A47L 23/04; A47L 23/06; A47L 23/18
See application file for complete search history.

(56) References Cited

U.S. PATENT DOCUMENTS

| | | | | | |
|---|---|---|---|---|---|
| 773,432 | A * | 10/1904 | Speer | A47L 23/02 | 15/34 |
| 947,415 | A * | 1/1910 | La Mountain | A47L 23/02 | 15/30 |
| 1,219,148 | A * | 3/1917 | Pootmans | A47L 23/02 | 15/33 |
| 1,448,342 | A * | 3/1923 | Harris | A47L 23/02 | 15/31 |
| 1,647,393 | A * | 11/1927 | Carek | A47L 23/04 | 15/36 |
| 2,653,694 | A | 9/1953 | Arnold | | |
| D186,014 | S | 2/1959 | Barba | | |
| 3,143,752 | A | 8/1964 | Bela | | |
| 3,831,217 | A | 8/1974 | Odawara | | |
| 4,599,760 | A | 7/1986 | Thomas | | |
| 8,495,780 | B2 | 7/2013 | Back | | |
| 2010/0306935 | A1 | 12/2010 | Florian | | |
| 2011/0252585 | A1 | 10/2011 | Lee | | |

FOREIGN PATENT DOCUMENTS

| | | | |
|---|---|---|---|
| EP | 0 791 323 A2 | * | 8/1997 |
| GB | 164576 | * | 6/1921 |
| KR | 10-0964321 B1 | * | 6/2010 |
| WO | 2009037671 | | 3/2009 |

* cited by examiner

*Primary Examiner* — Randall E Chin
(74) *Attorney, Agent, or Firm* — Kyle A. Fletcher, Esq.

(57) ABSTRACT

The shoe shining device is configured for use with a shoe. The shoe shining device is a mechanical device that buffs the shoe. The shoe shining device comprises a shell, a drive mechanism, and a buffing structure. The shell contains the drive mechanism and the buffing structure. The buffing structure is a rotating structure that buffs a shoe placed within the shell. The drive mechanism moves the buffing structure within the shell such that the buffing structure has access to all the surfaces of the upper of the shoe. The drive mechanism provides the motive forces necessary to operate the buffing structure.

15 Claims, 9 Drawing Sheets

AUTOMATIC SHOE-SHINING DEVICE

CROSS REFERENCES TO RELATED APPLICATIONS

Not Applicable

STATEMENT REGARDING FEDERALLY SPONSORED RESEARCH

Not Applicable

REFERENCE TO APPENDIX

Not Applicable

BACKGROUND OF THE INVENTION

Field of the Invention

The present invention relates to the field of domestic cleaning, more specifically, a shoe cleaning machine. (A47L23/02)

SUMMARY OF INVENTION

The shoe shining device is configured for use with a shoe. The shoe shining device is a mechanical device that buffs the shoe. The shoe shining device comprises a shell, a drive mechanism, and a buffing structure. The shell contains the drive mechanism and the buffing structure. The buffing structure is a rotating structure that buffs a shoe placed within the shell. The drive mechanism moves the buffing structure within the shell such that the buffing structure has access to all the surfaces of the upper of the shoe. The drive mechanism provides the motive forces necessary to operate the buffing structure.

These together with additional objects, features and advantages of the shoe shining device will be readily apparent to those of ordinary skill in the art upon reading the following detailed description of the presently preferred, but nonetheless illustrative, embodiments when taken in conjunction with the accompanying drawings.

In this respect, before explaining the current embodiments of the shoe shining device in detail, it is to be understood that the shoe shining device is not limited in its applications to the details of construction and arrangements of the components set forth in the following description or illustration. Those skilled in the art will appreciate that the concept of this disclosure may be readily utilized as a basis for the design of other structures, methods, and systems for carrying out the several purposes of the shoe shining device.

It is therefore important that the claims be regarded as including such equivalent construction insofar as they do not depart from the spirit and scope of the shoe shining device. It is also to be understood that the phraseology and terminology employed herein are for purposes of description and should not be regarded as limiting.

BRIEF DESCRIPTION OF DRAWINGS

The accompanying drawings, which are included to provide a further understanding of the invention are incorporated in and constitute a part of this specification, illustrate an embodiment of the invention and together with the description serve to explain the principles of the invention. They are meant to be exemplary illustrations provided to enable persons skilled in the art to practice the disclosure and are not intended to limit the scope of the appended claims.

DETAILED DESCRIPTION OF THE EMBODIMENT

The following detailed description is merely exemplary in nature and is not intended to limit the described embodiments of the application and uses of the described embodiments. As used herein, the word "exemplary" or "illustrative" means "serving as an example, instance, or illustration." Any implementation described herein as "exemplary" or "illustrative" is not necessarily to be construed as preferred or advantageous over other implementations. All of the implementations described below are exemplary implementations provided to enable persons skilled in the art to practice the disclosure and are not intended to limit the scope of the appended claims. Furthermore, there is no intention to be bound by any expressed or implied theory presented in the preceding technical field, background, brief summary or the following detailed description.

Figure 1:
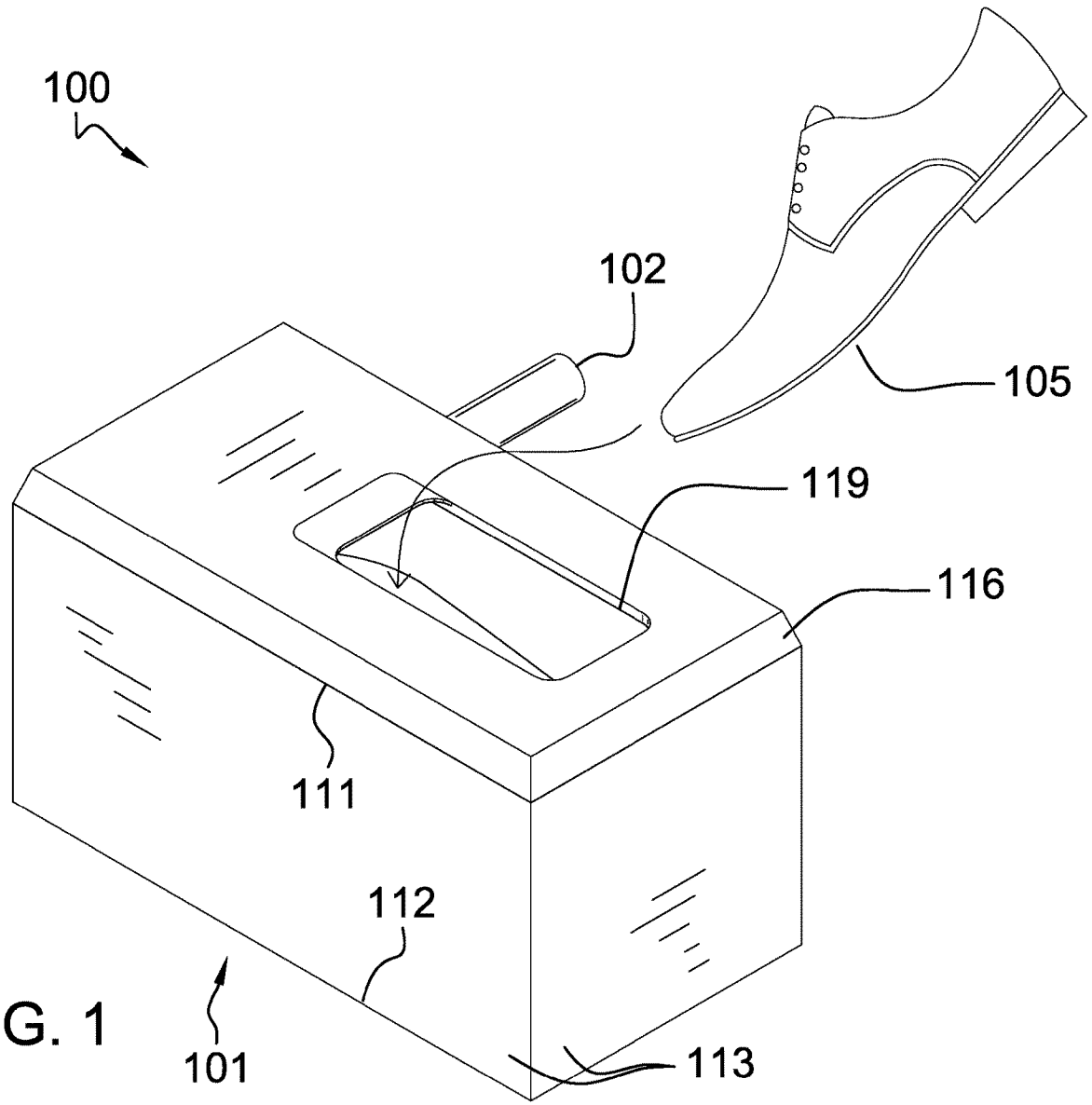
FIG. 1 is a perspective view of an embodiment of the disclosure.
Figure 2:
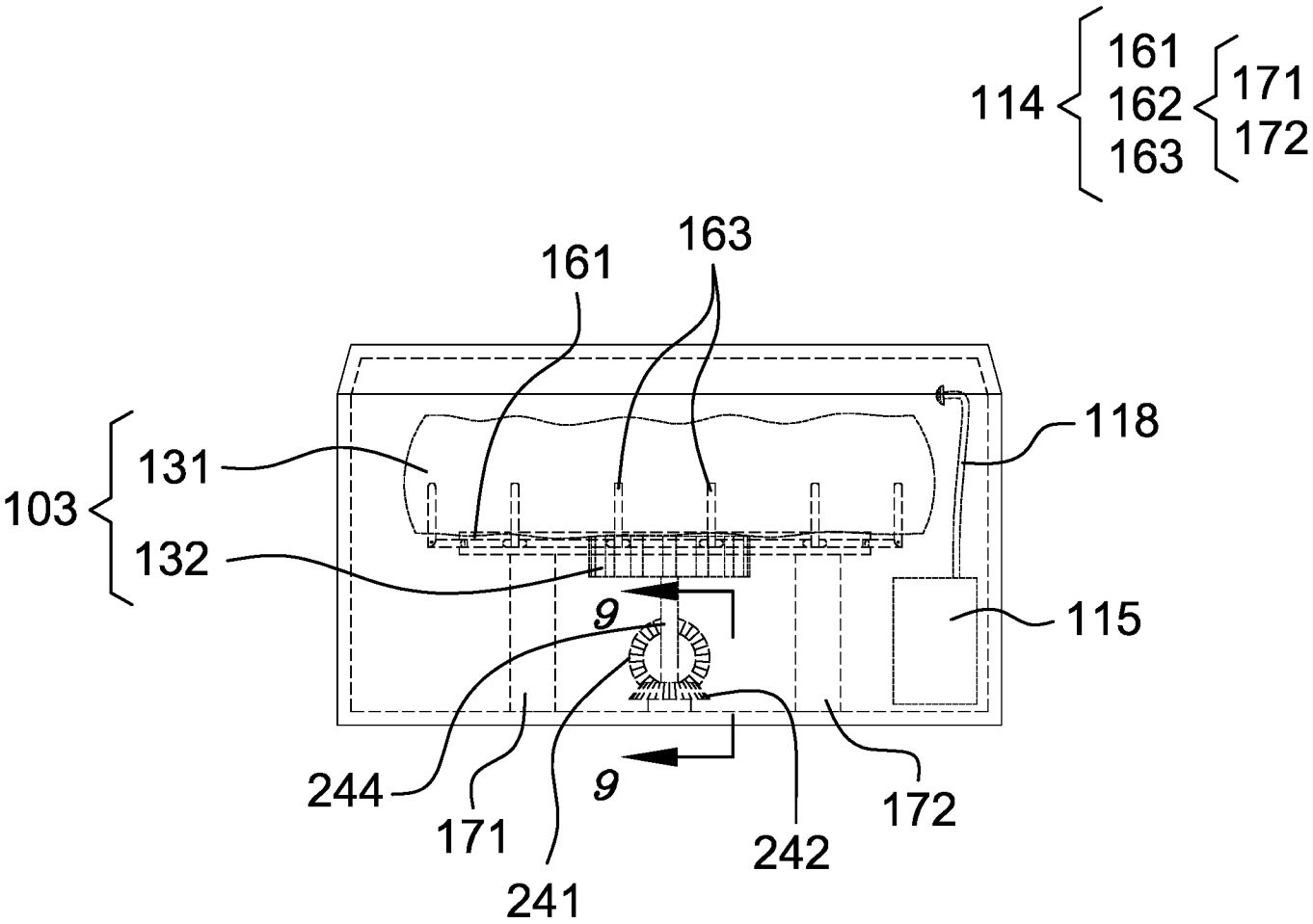
FIG. 2 is a front view of an embodiment of the disclosure.
Figure 3:
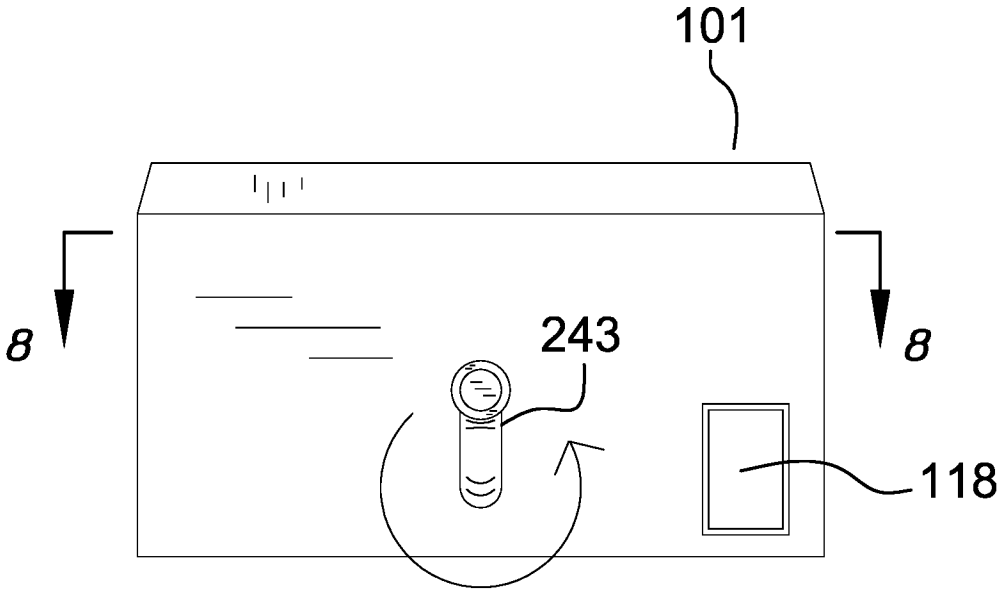
FIG. 3 is a rear view of an embodiment of the disclosure.
Figure 5:
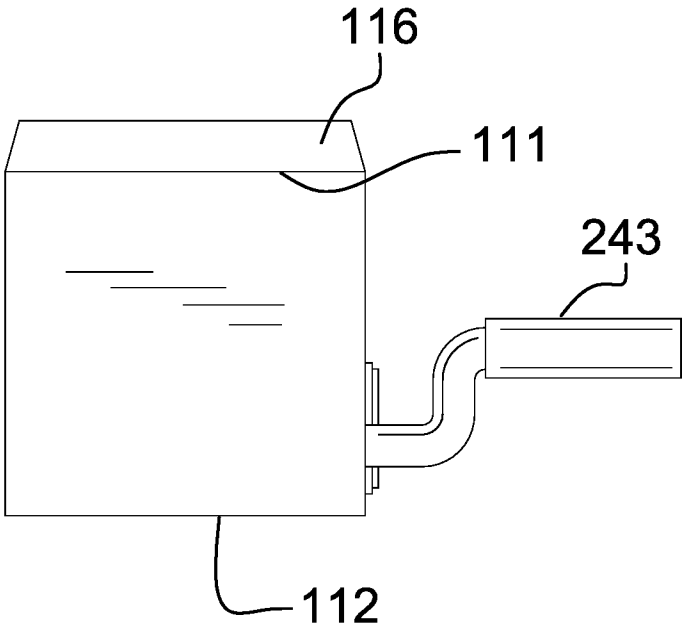
FIG. 5 is a reverse side view of an embodiment of the disclosure.
Figure 4:
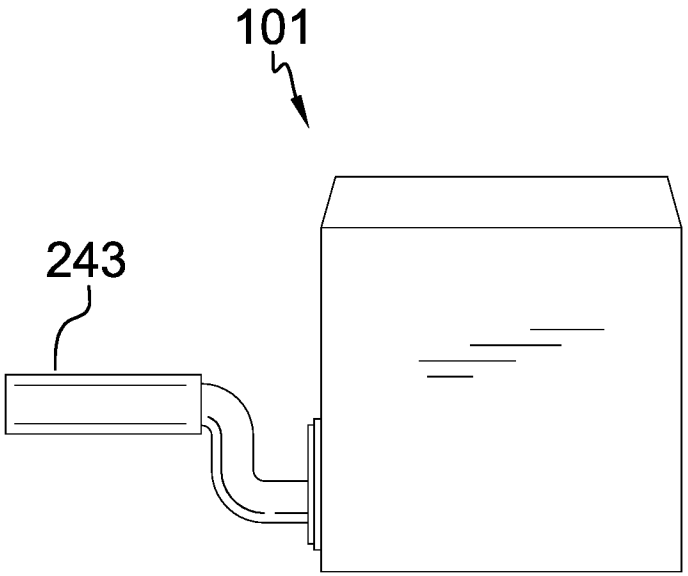
FIG. 4 is a side view of an embodiment of the disclosure.
Figure 6:
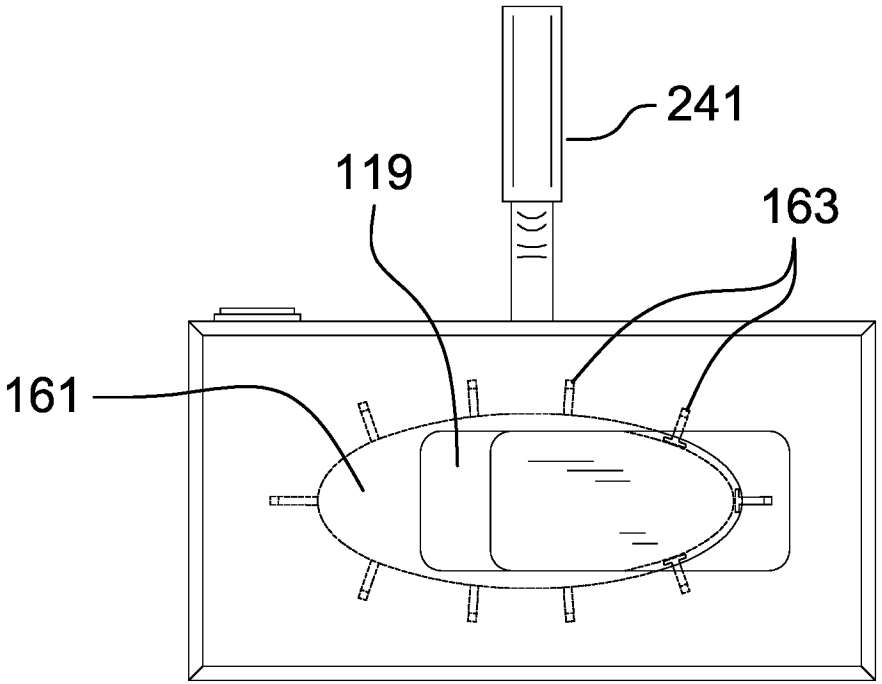
FIG. 6 is a top view of an embodiment of the disclosure.
Figure 7:
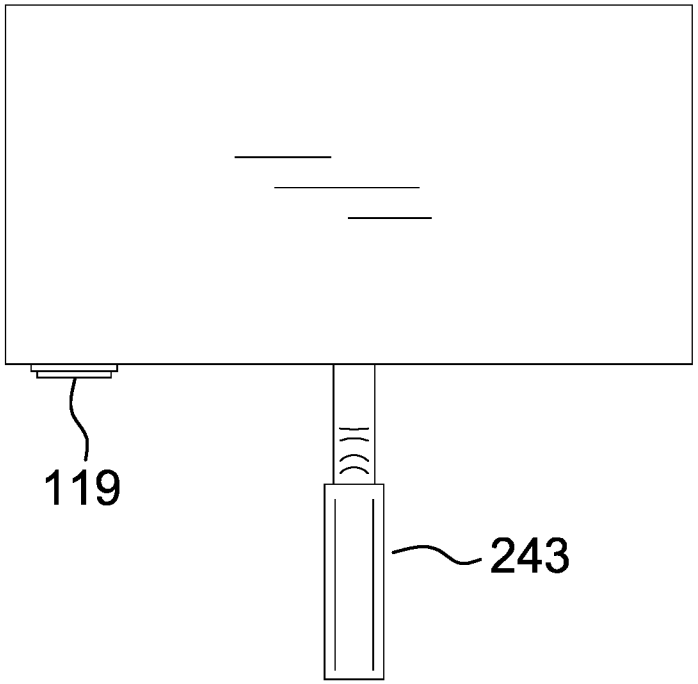
FIG. 7 is a bottom view of an embodiment of the disclosure.
Figure 8:
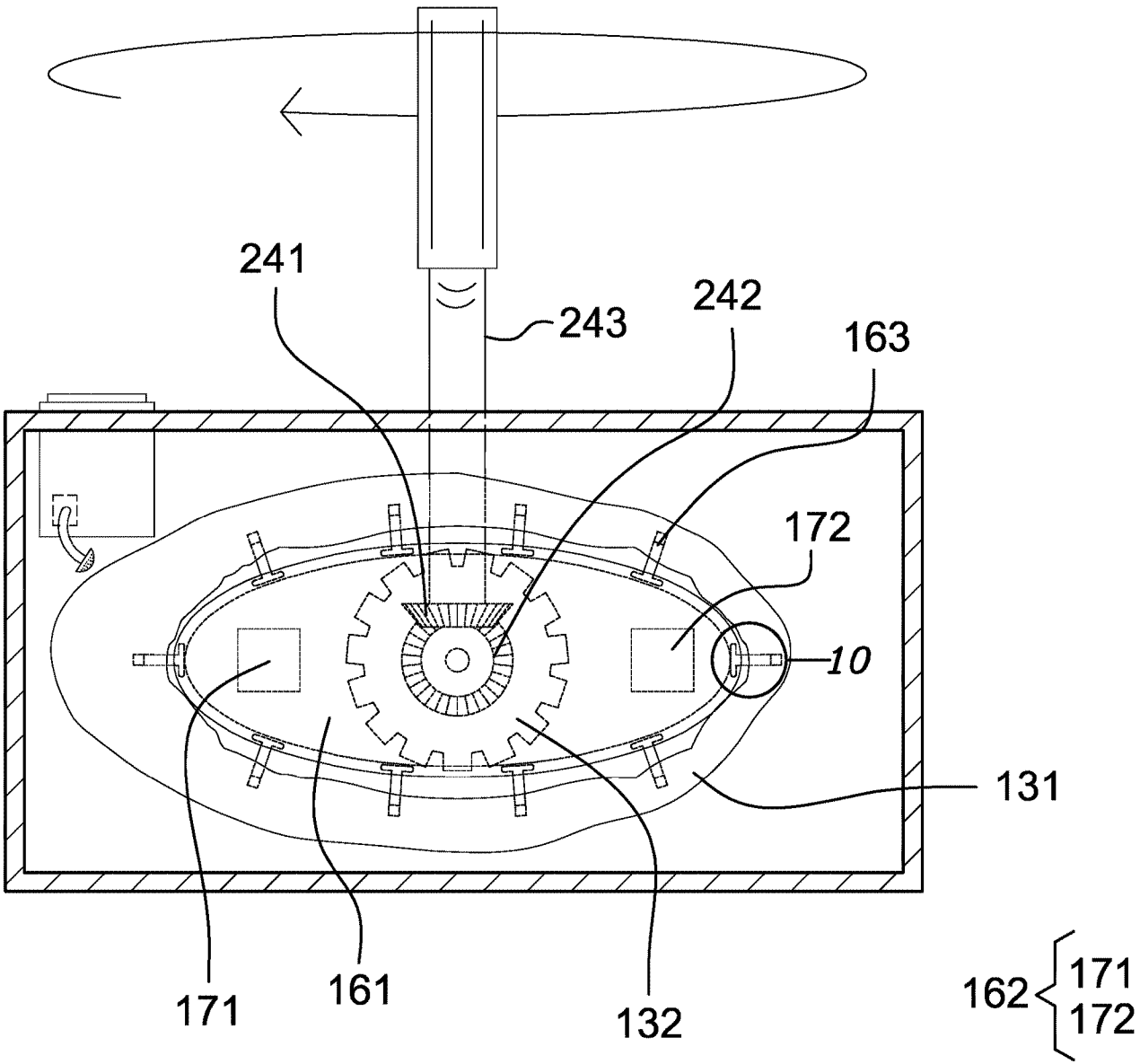
FIG. 8 is cross-sectional view of an embodiment of the disclosure.
Figure 9:
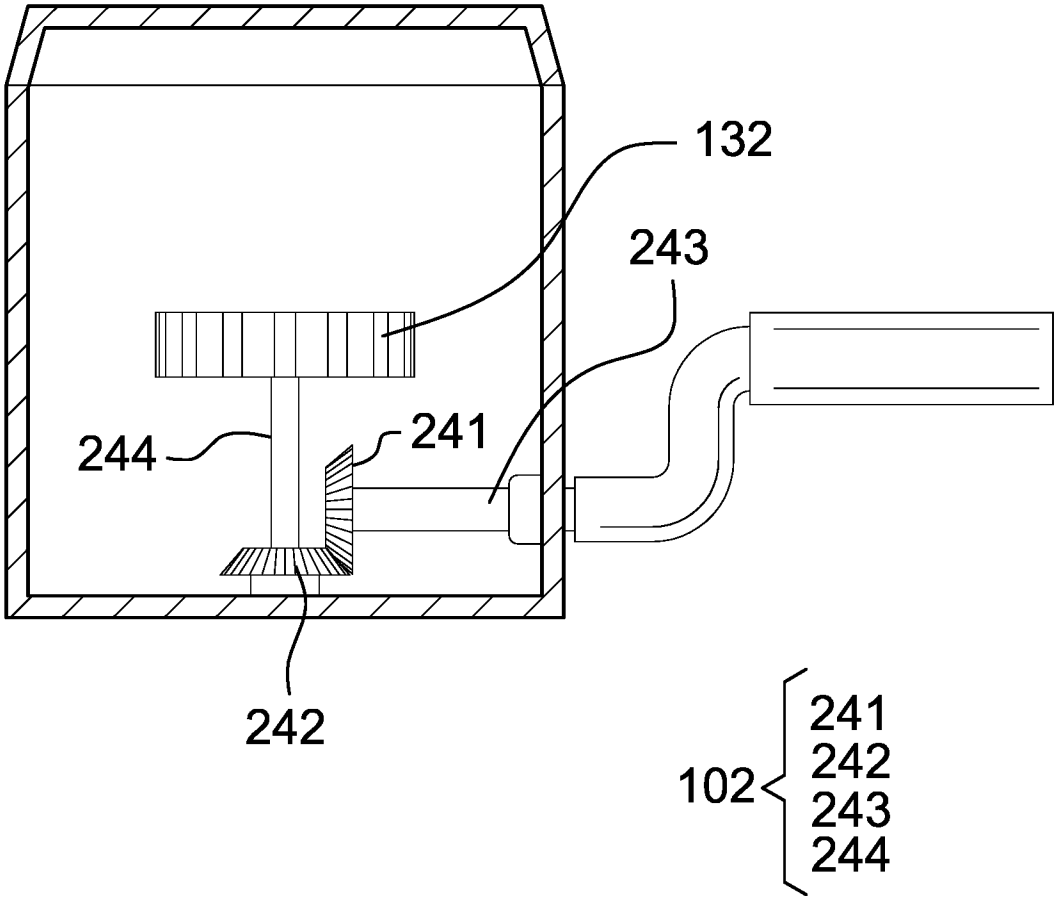
FIG. 9 is a detail view of an embodiment of the disclosure.
Figure 10:
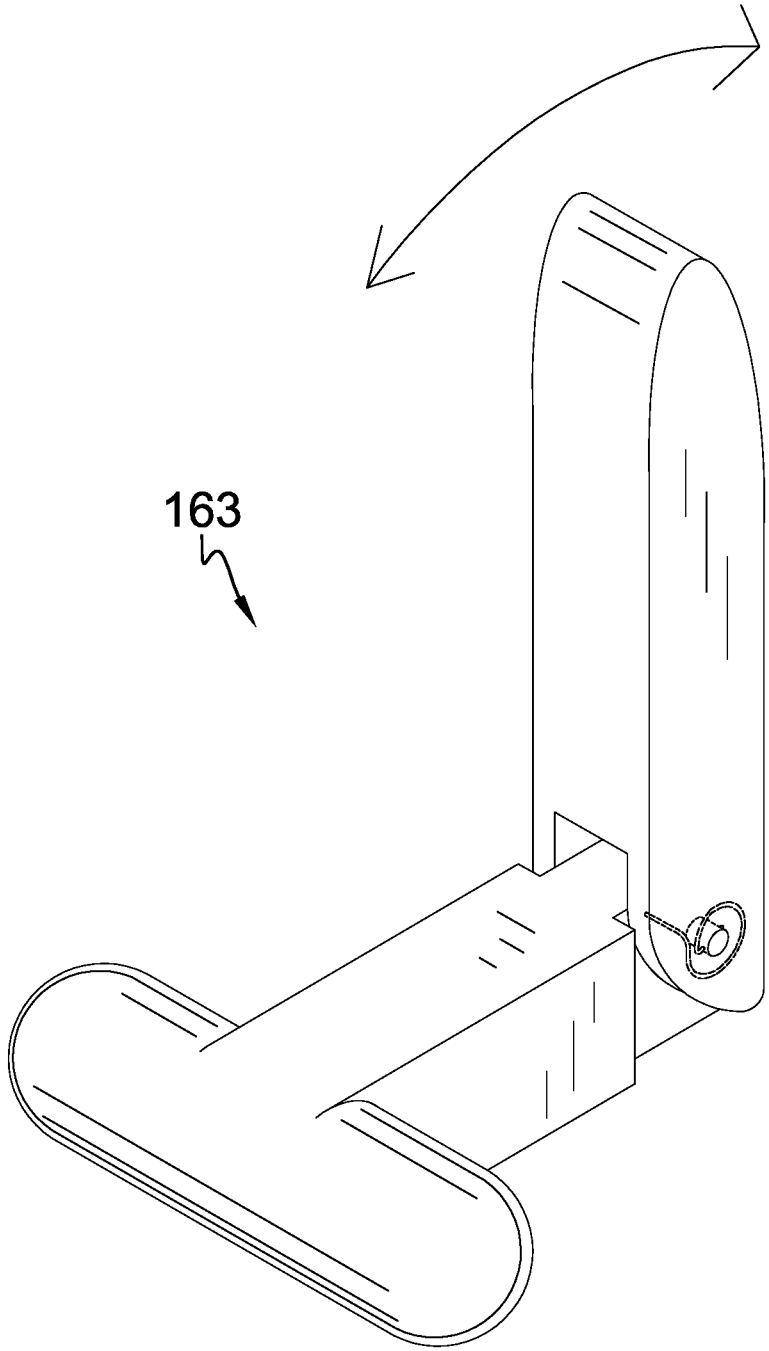
FIG. 10 is a detail view of an embodiment of the disclosure.

Detailed reference will now be made to one or more potential embodiments of the disclosure, which are illustrated in FIGS. 1 through 10.

The shoe shining device 100 (hereinafter invention) is configured for use with a shoe 105. The invention 100 is a mechanical device that buffs the shoe 105. The shoe 105 is defined elsewhere in this disclosure.

The invention 100 comprises a shell 101, a drive mechanism 102, and a buffing structure 103. The shell 101 contains the drive mechanism 102 and the buffing structure 103. The drive mechanism 102 rotates the buffing structure 103 within the shell 101. The buffing structure 103 is a rotating structure that buffs a shoe 105 placed within the shell 101. The drive mechanism 102 moves the buffing structure 103 within the shell 101 such that the buffing structure 103 has access to all the surfaces of the upper of the shoe 105. The drive mechanism 102 is a manually operated mechanical structure that powers the rotation of the buffing structure 103.

The shell 101 is a prism-shaped structure. The shell 101 is a hollow structure. The shell 101 forms the exterior surfaces of the invention 100. The shell 101 contains the drive mechanism 102 and the buffing structure 103. The shell 101 switches between an open position and a closed position. In the open position, the shell 101 provides access to the hollow interior of the shell 101 to allow for the insertion and the removal of the shoe 105. In the closed position, the shell 101 prevents access to the hollow interior of the shell 101. The shell 101 comprises an open face 111, a closed face 112, a plurality of lateral faces 113, a shoe 105 saddle 114, a compound reservoir 115, and a lid 116.

The open face 111, the closed face 112, and the plurality of lateral faces 113 form a pan structure that forms the storage space provided by the shell 101. The shoe 105 saddle 114 is a mechanical structure that positions the shoe 105 within the pan structure of the shell 101. The compound reservoir 115 is a segregated storage structure that is formed within the pan structure of the shell 101. The compound reservoir 115 is configured to store a cleaning solution within the pan structure of the shell 101. The compound reservoir 115 further comprises a universal dispensing pump 118. The cleaning solution contained within the compound reservoir 117 is dispensed directly onto the shoe 105 using the universal dispenser pump 118. The universal dispenser pump 118 is a pump that generates a pressure differential that transports the cleaning solution from the compound reservoir 115 directly onto the exterior surface of the upper of the shoe 105.

The open face 111 forms the open face 111 of the pan structure of the shell 101. The open face 111 provides access into the hollow interior of the pan structure of the shell 101. The closed face 112 forms the closed face 112 of the pan structure of the shell 101. The closed face 112 forms a horizontally oriented enclosing boundary of the pan structure of the shell 101. The closed face 112 is the face of the pan structure of the shell 101 that is distal from the open face 111.

The plurality of lateral faces 113 forms the lateral face structure of the pan structure of the shell 101. Each of the plurality of lateral faces 113 forms a vertically oriented enclosing boundary of the pan structure of the shell 101.

The shoe 105 saddle 114 is a mechanical structure. The shoe 105 saddle 114 attaches to the vertically oriented interior surfaces formed by the plurality of lateral faces 113 of the shell 101. The shoe 105 saddle 114 receives the shoe 105 that is to be cleaned. The shoe 105 saddle 114 holds the shoe 105 in a fixed position within the pan structure of the shell 101. The shoe 105 saddle 114 comprises a shoe 105 mount 161, a plurality of stanchions 162, and a plurality of L-brackets 163.

The shoe 105 mount 161 is a horizontally oriented platform. The shoe 105 mount 161 is elevated above the closed face 112 of the shell 101. The shoe 105 mount 161 forms the platform on which the shoe 105 rests during the cleaning process. Each of the plurality of L-brackets 163 is identical. Each of the plurality of L-brackets 163 is a spring loaded structure. Each L-bracket selected from the plurality of L-brackets 163 mounts on the perimeter of the shoe mount 105 such that each selected L-bracket presses against the shoe 105 as the spring of the selected L-bracket moves towards its relaxed shape. The plurality of L-brackets 163 combine to secure the shoe 105 onto the platform during the cleaning process.

Each of the plurality of stanchions 162 is a mechanical structure that elevates the shoe 105 mount 161 above the closed face 112 of the shell 101. Each of the plurality of stanchions 162 attaches to interior surface of the closed face 112 of the shell 101. Each of the plurality of stanchions 162 forms a portion of the load path that transfers the loads of the shoe 105 and the shoe 105 mount 161 to the closed face 112 of shell 101. The plurality of stanchions 162 comprises a first stanchion 171 and a second stanchion 172.

The first stanchion 171 is a stanchion selected from the plurality of stanchions 162 that attaches the shoe 105 mount 161 to the interior surface of the closed face 112 of the shell 101. The second stanchion 172 is a stanchion selected from the plurality of stanchions 162 that attaches the shoe 105 mount 161 to the interior surface of the closed face 112 of the shell 101.

The lid 116 is a prism-shaped structure. The lid 116 has a disk shape. The lid 116 is geometrically similar to the open face 111. The lid 116 is sized such that the lid 116 encloses the open face 111 of the pan structure of the shell 101. The lid 116 is a hinged structure that rotates between a closed position and an open position such that the drive mechanism 102 and the buffing structure 103 are accessible for maintenance.

The lid 116 further comprises a lid 116 aperture 119. The lid 116 aperture 119 is an aperture that is formed through the lid 116. The lid 116 aperture 119 is formed through the lid 116 such that the lid 116 aperture 119 is centered above the shoe 105 mount 161. The shoe 105 is placed on the shoe 105 mount 161 by inserting through the lid 116 aperture 119.

The drive mechanism 102 is a mechanical device. The drive mechanism 102 mechanically rotates the buffing structure 103 within the shell 101. The drive mechanism 102 is a hand operated device. The drive mechanism 102 comprises a first bevel gear 241, a second bevel gear 242, a crank 243, and a drive shaft 244. The first bevel gear 241 forms a mechanical linkage between the crank 243 and the second bevel gear 242. The second bevel gear 242 forms a mechanical linkage between the first bevel gear 241 and the drive shaft 244. The drive mechanism 102 transfer transfers rotational energy manually generated at the crank 243 to rotational energy that is presented by the drive shaft 244 to the buffing structure 103.

The first bevel gear 241 rigidly attaches to the crank 243 such that the rotation of the crank 243 rotates the first bevel gear 241. The first bevel gear 241 meshes with the second bevel gear 242 such that the rotation of the first bevel gear 241 rotates the second bevel gear 242. The first bevel gear 241 meshes with the second bevel gear 242 such that the axis of rotation of the first bevel gear 241 is perpendicular to the axis of rotation of the second bevel gear 242. The second bevel gear 242 rigidly attaches to the drive shaft 244 such that the rotation of the second bevel gear 242 rotates the drive shaft 244.

The buffing structure 103 is a mechanical structure. The buffing structure 103 is a rotating structure. The buffing structure 103 cleans the shoe 105. The rotation of the buffing structure 103 generates a friction used to clean all the exterior surfaces of the upper structure of the shoe 105. The buffing structure 103 comprises a buffing band 131 and a transmission mechanism 132.

The buffing band 131 is a sheeting structure. The buffing band 131 is shaped as a band. The buffing band 131 is a webbing that is formed with a nap. The terms band, webbing, and nap are defined elsewhere in this disclosure. The buffing band 131 is an elastic structure. The elastic nature of the buffing band 131 allows the buffing band 131 to maintain a pressure against the exterior surfaces of the upper structure of the shoe 105 as the transmission mechanism 132 rotates the buffing band 131 around the exterior surfaces of the upper structure of the shoe 105. The buffing band 131 is the structure of the buffing structure 103 that rubs against the exterior surfaces of the upper structure of the shoe 105. The napped surface of the buffing band 131 rubs against the exterior surfaces of the upper structure of the shoe 105 to generate a friction used to clean the exterior surfaces of the upper structure of the shoe 105.

The transmission mechanism 132 is a mechanical structure. The transmission mechanism 132 uses the rotational energy generated by the drive mechanism 102 to rotate the buffing band 131 around the exterior surfaces of the upper structure of the shoe 105. The transmission mechanism 132 attaches to the drive shaft 244 of the drive mechanism 102 such that the axes of rotation of the transmission mechanism 132 and the drive shaft 244 are aligned. The transmission mechanism 132 is a rotating structure. The transmission mechanism 132 forms a looped path through guides the buffing band 131 around the exterior surfaces of the upper structure of the shoe 105 during the cleaning process. The transmission mechanism 132 generates a continuous motion of the band through a loop formed by the transmission mechanism 132. The motion of the buffing band 131 through the transmission mechanism 132 generates the friction used to clean the exterior surfaces of the upper structure of the shoe 105. The transmission is defined elsewhere in this disclosure.

The following definitions were used in this disclosure:

Align: As used in this disclosure, align refers to an arrangement of objects that are: 1) arranged in a straight plane or line; 2) arranged to give a directional sense of a plurality of parallel planes or lines; or, 3) a first line or curve is congruent to and overlaid on a second line or curve.

Band: As used in this disclosure, a band is a flat loop of material.

Bevel Gear: As used in this disclosure, a bevel gear is a gear with teeth that are formed on a conical surface that is used to transmit motion between non-parallel or intersecting shafts.

Cantilever: As used in this disclosure, a cantilever is a beam or other structure that projects away from an object and is supported on only one end. A cantilever is further defined with a fixed end and a free end. The fixed end is the end of the cantilever that is attached to the object. The free end is the end of the cantilever that is distal from the fixed end.

Center: As used in this disclosure, a center is a point that is: 1) the point within a circle that is equidistant from all the points of the circumference; 2) the point within a regular polygon that is equidistant from all the vertices of the regular polygon; 3) the point on a line that is equidistant from the ends of the line; 4) the point, pivot, or axis around which something revolves; or, 5) the centroid or first moment of an area or structure. In cases where the appropriate definition or definitions are not obvious, the fifth option should be used in interpreting the specification.

Center Axis: As used in this disclosure, the center axis is the axis of a cylinder or a prism. The center axis of a prism is the line that joins the center point of the first congruent face of the prism to the center point of the second corresponding congruent face of the prism. The center axis of a pyramid refers to a line formed through the apex of the pyramid that is perpendicular to the base of the pyramid. When the center axes of two cylinder, prism or pyramidal structures share the same line they are said to be aligned. When the center axes of two cylinder, prism or pyramidal structures do not share the same line they are said to be offset.

Clean: As used in this disclosure, the term clean refers to an object without dirt, unwanted markings, or undesirable pathogens. When referring to a surface, the term clean can also refer to removing unwanted objects from the surface. The term cleaning refers to the action of making an object clean.

Cleaning Agent: As used in this disclosure, a cleaning agent is a chemical compound used to remove dirt and detritus from a surface.

Cleaning Solution: As used in this disclosure, a cleaning solution is a chemical solution that contains a solvent used to dissolve and capture dirt and detritus from a surface. The cleaning solution often contains a cleaning agent.

Closed Position: As used in this disclosure, a closed position refers to a movable barrier structure that is in an orientation that prevents passage through a port or an aperture. The closed position is often referred to as an object being "closed."

Congruent: As used in this disclosure, congruent is a term that compares a first object to a second object. Specifically, two objects are said to be congruent when: 1) they are geometrically similar; and, 2) the first object can superimpose over the second object such that the first object aligns, within manufacturing tolerances, with the second object.

Correspond: As used in this disclosure, the term correspond is used as a comparison between two or more objects wherein one or more properties shared by the two or more objects match, agree, or align within acceptable manufacturing tolerances.

Crank: As used in this disclosure, a crank is a handle or an arm that is attached perpendicularly to the axis of rotation of a shaft and that is used for transmitting rotary motion to the shaft.

Crankshaft: As used in this disclosure, a crankshaft is a cylindrical rod or shaft that: 1) is designed to rotate around its center axis; and 2) is driven by a crank.

Detritus: As used in this disclosure, detritus refers to an accumulation of unwanted material on a surface.

Disk: As used in this disclosure, a disk is a prism-shaped object that is flat in appearance. The disk is formed from two congruent ends that are attached by a lateral face. The sum of the surface areas of two congruent ends of the prism-shaped object that forms the disk is greater than the surface area of the lateral face of the prism-shaped object that forms the disk. In this disclosure, the congruent ends of the prism-shaped structure that forms the disk are referred to as the faces of the disk.

Elastic: As used in this disclosure, an elastic is a material or object that deforms when a force is applied to it and that is able to return to its relaxed shape after the force is removed. A material that exhibits these qualities is also referred to as an elastomeric material. A material that does not exhibit these qualities is referred to as inelastic or an inelastic material.

Elastic Nature: As used in this disclosure, an elastic nature refers to a flexible structure that returns to its relaxed shape after the flexible structure has been deformed.

Elastic Band: As used in this disclosure, an elastic band is a loop of textile that is formed using elastic material that can stretched. Alternatively, the elastic band can be a sheeting that is formed from latex, spandex, or an elastic plastic film that can be stretched.

Elastic Textile: As used in this disclosure, an elastic textile is a textile that contains elastic yarns as some of the yarns that make up the textile. An elastic textile is constructed such that the elastic textile will stretch when a force is applied and will return to its original shape when after the force is removed.

Elastic Webbing: As used in this disclosure, an elastic webbing is a webbing that contains elastic yarns as some of the yarns that make up the webbing. An elastic webbing is constructed such that the elastic webbing will stretch when a force is applied and will return to its original shape when after the force is removed.

Exterior: As used in this disclosure, the exterior is used as a relational term that implies that an object is not contained within the boundary of a structure or a space.

External Power Source: As used in this disclosure, an external power source is a source of the energy that is externally provided to enable the operation of the present disclosure. Examples of external power sources include, but are not limited to, electrical power sources and compressed air sources.

Footwear: As used in this disclosure, footwear refers to a protective structure that is worn on a foot. Footwear is commonly referred to as a shoe. Most commonly available footwear shares certain common characteristics including, but not limited to, an upper and a sole. The upper and sole are generally said to be attached at the feather. If the feather is reinforced with an additional piece of material, the additional piece of material is referred to as a welt. The upper is divided into a quarter regions and a vamp region. The superior edge of the upper is called the top line (or collar). A foot typically enters footwear through the top line. The quarter region covers the heel of the foot. The vamp region covers the toes and attaches to the quarter. The sole forms a pedestal between the foot and the ground. The sole is further defined with an insole and an outsole. The insole is the surface of the sole that is proximal to the foot when the footwear is worn normally. The outsole is the surface of the sole that is distal from the insole. The sole is often fitted with a heel which is a structure that is designed to raise the quarter portion of the footwear above the vamp. The tongue is a flap of material that is attached to the upper such that the tongue is positioned between a foot and the upper. The tongue is attached to the upper at the frenulum.

Force of Gravity: As used in this disclosure, the force of gravity refers to a vector that indicates the direction of the pull of gravity on an object at or near the surface of the earth.

Form Factor: As used in this disclosure, the term form factor refers to the size and shape of an object.

Friction: As used in this disclosure, friction refers to a force that occurs between two objects that are in relative motion while in contact with each other. The force resists the relative motion of the two objects. More technically, friction refers to an exchange of energy between two objects that are in contact with each other that converts the energy of a directed relative motion between the two objects into randomly directed motions of the molecules that form both objects.

Gear: As used in this disclosure, a gear is a toothed wheel, cylinder, or other toothed mechanical element that is used to transmit motion, a change of speed, or a change of direction to second toothed wheel, cylinder, or other toothed mechanical element.

Geometrically Similar: As used in this disclosure, geometrically similar is a term that compares a first object to a second object wherein: 1) the sides of the first object have a one to one correspondence to the sides of the second object; 2) wherein the ratio of the length of each pair of corresponding sides are equal; 3) the angles formed by the first object have a one to one correspondence to the angles of the second object; and, 4) wherein the corresponding angles are equal. The term geometrically identical refers to a situation where the ratio of the length of each pair of corresponding sides equals 1.

Hinge: As used in this disclosure, a hinge is a device that permits the turning, rotating, or pivoting of a first object relative to a second object. A hinge designed to be fixed into a set position after rotation is called a locking hinge. A spring loaded hinge is a hinge formed as an elastic structure. The elastic structure of the spring loaded hinge is deformed under a rotating force such that the elastic structure returns the spring loaded hinge back to its relaxed shape after the rotating force is removed from the spring loaded hinge.

Horizontal: As used in this disclosure, horizontal is a directional term that refers to a direction that is either: 1) parallel to the horizon; 2) perpendicular to the local force of gravity, or, 3) parallel to a supporting surface. In cases where the appropriate definition or definitions are not obvious, the second option should be used in interpreting the specification. Unless specifically noted in this disclosure, the horizontal direction is always perpendicular to the vertical direction.

Inelastic Nature: As used in this disclosure, an inelastic nature refers to a flexible structure that maintains its new shape after the flexible structure has been deformed.

Inferior: As used in this disclosure, the term inferior refers to a directional reference that is parallel to and in the same direction as the force of gravity when an object is positioned or used normally.

Interior: As used in this disclosure, the interior is used as a relational term that implies that an object is contained within the boundary of a structure or a space.

Jib: As used in this disclosure, a jib is a beam structure that: 1) is mounted with a free end in the manner of a cantilever; and, 2) suspends a load at the free end of the jib. In multicomponent beam structures, such as with a crane, the jib is the sub-structure that physically suspends the load.

Lid: As used in this disclosure, a lid is a removable cover that is placed over an opening of a hollow structure to enclose the hollow structure.

Loop: As used in this disclosure, a loop is the length of a first linear structure including, but not limited to, shafts, lines, cords, or webbings, that is: 1) folded over and joined at the ends forming an enclosed space; or, 2) curved to form a closed or nearly closed space within the first linear structure. In both cases, the space formed within the first linear structure is such that a second linear structure such as a line, cord or a hook can be inserted through the space formed within the first linear structure. Within this disclosure, the first linear structure is said to be looped around the second linear structure.

Mechanical Linkage: As used in this disclosure, a mechanical linkage is an interconnected arrangement of components that are used to manage the transfer of a movement or a force. A mechanical linkage is often referred to as a linkage.

Nap: As used in this disclosure, a nap refers to one or more loose yarns that are incorporated in a textile such that the separated, or "raised," from the plane of the primary surface of a textile. A nap may: 1) take the form of a loop; or 2) take the form of loose "ends" extending beyond the textile. Within this disclosure, the terms pile and nap may considered synonyms. A textile comprising a plurality of napped yarns is often referred to as a plush textile.

Negative Space: As used in this disclosure, negative space is a method of defining an object through the use of open or empty space as the definition of the object itself, or, through the use of open or empty space to describe the boundaries of an object.

One to One: When used in this disclosure, a one to one relationship means that a first element selected from a first set is in some manner connected to only one element of a second set. A one to one correspondence means that the one to one relationship exists both from the first set to the second set and from the second set to the first set. A one to one fashion means that the one to one relationship exists in only one direction.

Open Position: As used in this disclosure, an open position refers to a movable barrier structure that is in an orientation that allows passage through a port or an aperture. The open position is often referred to as an object being "open."

Orientation: As used in this disclosure, orientation refers to the positioning of a first object relative to: 1) a second object; or, 2) a fixed position, location, or direction.

Pan: As used in this disclosure, a pan is a hollow and prism-shaped containment structure. The pan has a single open face. The open face of the pan is often, but not always, the superior face of the pan. The open face is a surface selected from the group consisting of: a) a congruent end of the prism structure that forms the pan; and, b) a lateral face of the prism structure that forms the pan. A semi-enclosed pan refers to a pan wherein the closed end of the prism structure of the pan and/or a portion of the closed lateral faces of the pan is are open.

Perimeter: As used in this disclosure, a perimeter is one or more curved or straight lines that bounds an enclosed area on a plane or surface. The perimeter of a circle is commonly referred to as a circumference.

Pivot: As used in this disclosure, a pivot is a rod or shaft around which an object rotates or swings.

Prism: As used in this disclosure, a prism is a three-dimensional geometric structure wherein: 1) the form factor of two faces of the prism are congruent; and, 2) the two congruent faces are parallel to each other. The two congruent faces are also commonly referred to as the ends of the prism. The surfaces that connect the two congruent faces are called the lateral faces. In this disclosure, when further description is required a prism will be named for the geometric or descriptive name of the form factor of the two congruent faces. If the form factor of the two corresponding faces has no clearly established or well-known geometric or descriptive name, the term irregular prism will be used. The center axis of a prism is defined as a line that joins the center point of the first congruent face of the prism to the center point of the second corresponding congruent face of the prism. The center axis of a prism is otherwise analogous to the center axis of a cylinder. A prism wherein the ends are circles is commonly referred to as a cylinder.

Relaxed Shape: As used in this disclosure, a structure is considered to be in its relaxed state when no shear, strain, or torsional forces are being applied to the structure.

Reservoir: As used in this disclosure, a reservoir refers to a container or containment system that is configured to store a liquid.

Shoe: As used in this disclosure, shoe is a synonym for footwear that excludes open footwear with a primarily open upper such as sandals and flip flops.

Spring: As used in this disclosure, a spring is a device that is used to store mechanical energy. This mechanical energy will often be stored by: 1) deforming an elastomeric material that is used to make the device; 2) the application of a torque to a semi-rigid structure; or 3) a combination of the previous two items.

Stanchion: As used in this disclosure, a stanchion refers to a vertically oriented prism-shaped pole, post, or support.

Superior: As used in this disclosure, the term superior refers to a directional reference that is parallel to and in the opposite direction of the force of gravity when an object is positioned or used normally.

Textile: As used in this disclosure, a textile is a material that is woven, knitted, braided or felted. Synonyms in common usage for this definition include fabric and cloth. The two surfaces of the textile with the greatest surface area are called the faces of the textile.

Transmission: As used in this disclosure, a transmission is a device that transmits the energy of motion from a first location to a second location.

Universal Dispenser Pump: As used in this disclosure, a universal dispenser pump is a pump that is used to pump a liquid out of a bottle. The universal dispenser pump is a well-known and documented commercially available product that is often referred to as a soap pump or a shampoo pump.

Vertical: As used in this disclosure, vertical refers to a direction that is either: 1) perpendicular to the horizontal direction; 2) parallel to the local force of gravity; or, 3) when referring to an individual object the direction from the designated top of the individual object to the designated bottom of the individual object. In cases where the appropriate definition or definitions are not obvious, the second option should be used in interpreting the specification. Unless specifically noted in this disclosure, the vertical direction is always perpendicular to the horizontal direction.

Webbing: As used in this disclosure, a webbing is strong, close woven or knitted fabric that is used for straps or belting. As used in this disclosure, webbing is a fully formed material that is only cut to length for use. Webbing is not formed by cutting broader materials into strips. Webbings have tensile strength but are too flexible to provide compressive strength and are not suitable for use in pushing objects. The shape of a webbing is approximated by a rectangular disk shape. The two surfaces of a webbing with the greatest surface area are called the faces of the webbing.

With respect to the above description, it is to be realized that the optimum dimensional relationship for the various components of the invention described above and in FIGS. 1 through 10 include variations in size, materials, shape, form, function, and manner of operation, assembly and use, are deemed readily apparent and obvious to one skilled in the art, and all equivalent relationships to those illustrated in the drawings and described in the specification are intended to be encompassed by the invention.

It shall be noted that those skilled in the art will readily recognize numerous adaptations and modifications which can be made to the various embodiments of the present invention which will result in an improved invention, yet all of which will fall within the spirit and scope of the present invention as defined in the following claims. Accordingly, the invention is to be limited only by the scope of the following claims and their equivalents.

The inventor claims:

1. A shoe shining device comprising a shell, a drive mechanism, and a buffing structure;

wherein the shell contains the drive mechanism and the buffing structure;

wherein the drive mechanism rotates the buffing structure within the shell;

wherein the shell comprises an open face, a closed face, a plurality of lateral faces, a shoe saddle, a compound reservoir, and a lid;

wherein the shoe saddle comprises a shoe mount, a plurality of stanchions, and a plurality of I-brackets;

wherein the shoe mount is a horizontally oriented platform;

wherein the shoe mount is elevated above the closed face of the shell;

wherein the shoe mount forms the platform on which the shoe rests during a cleaning process;

wherein each of the plurality of I-brackets is identical;

wherein each of the plurality of I-brackets is a spring loaded structure;

wherein each I-bracket selected from the plurality of I-brackets mounts on the perimeter of the shoe mount such that each selected I-bracket presses against the shoe as the spring of the selected I-bracket moves towards its relaxed shape;

wherein the plurality of I-brackets combine to secure the shoe onto the platform during the cleaning process;

wherein each of the plurality of stanchions is a mechanical structure that elevates the shoe mount above the closed face of the shell;

wherein each of the plurality of stanchions attaches to interior surface of the closed face of the shell;

wherein each of the plurality of stanchions forms a portion of the load path that transfers the loads of the shoe and the shoe mount to the closed face of shell.

2. The shoe shining device according to claim 1 wherein the shoe shining device is configured for use with a shoe;

wherein the shoe shining device is a mechanical device that buffs the shoe;

wherein the buffing structure is a rotating structure that buffs the shoe within the shell;

wherein the drive mechanism moves the buffing structure within the shell such that the buffing structure has access to all the surfaces of the upper of the shoe.

3. The shoe shining device according to claim 2 wherein the drive mechanism is a manually operated mechanical structure that powers the rotation of the buffing structure.

4. The shoe shining device according to claim 3 wherein the shell is a prism-shaped structure;

wherein the shell is a hollow structure;

wherein the shell forms the exterior surfaces of the shoe shining device.

5. The shoe shining device according to claim 4 wherein the drive mechanism is a mechanical device;

wherein the drive mechanism mechanically rotates the buffing structure within the shell;

wherein the drive mechanism is a hand operated device.

6. The shoe shining device according to claim 5 wherein the buffing structure is a mechanical structure;

wherein the buffing structure cleans the shoe;

wherein the rotation of the buffing structure generates a friction used to clean all the exterior surfaces of the upper structure of the shoe.

7. The shoe shining device according to claim 6 wherein the open face, the closed face, and the plurality of lateral faces form a pan structure that forms the storage space provided by the shell;

wherein the shoe saddle is a mechanical structure that positions the shoe within the pan structure of the shell;

wherein the compound reservoir is a segregated storage structure that is formed within the pan structure of the shell;

wherein the lid is a prism-shaped structure;

wherein the lid has a disk shape;

wherein the lid is geometrically similar to the open face;

wherein the lid is sized such that the lid encloses the open face of the pan structure of the shell.

8. The shoe shining device according to claim 7 wherein the drive mechanism comprises a first bevel gear, a second bevel gear, a crank, and a drive shaft;

wherein the first bevel gear forms a mechanical linkage between the crank and the second bevel gear;

wherein the second bevel gear forms a mechanical linkage between the first bevel gear and the drive shaft;

wherein the drive mechanism transfer rotational energy manually generated at the crank to rotational energy that is presented by the drive shaft to the buffing structure.

9. The shoe shining device according to claim 8 wherein the buffing structure comprises a buffing band and a transmission mechanism;

wherein the transmission mechanism is a mechanical structure;

wherein the transmission mechanism uses rotational energy generated by the drive mechanism to rotate the buffing band around the exterior surfaces of the upper structure of the shoe.

10. The shoe shining device according to claim 9 wherein the compound reservoir is configured to store a cleaning solution within the pan structure of the shell;

wherein the compound reservoir further comprises a universal dispensing pump;

wherein the cleaning solution contained within the compound reservoir is dispensed directly onto the shoe using the universal dispenser pump;

wherein the universal dispenser pump is a pump that generates a pressure differential that transports the cleaning solution from the compound reservoir directly onto the exterior surface of the upper of the shoe.

11. The shoe shining device according to claim 10 wherein the open face forms the open face of the pan structure of the shell;

wherein the open face provides access into the hollow interior of the pan structure of the shell;

wherein the closed face forms the closed face of the pan structure of the shell;

wherein the closed face forms a horizontally oriented enclosing boundary of the pan structure of the shell;

wherein the closed face is the face of the pan structure of the shell that is distal from the open face;

wherein the plurality of lateral faces forms the lateral face structure of the pan structure of the shell;

wherein each of the plurality of lateral faces forms a vertically oriented enclosing boundary of the pan structure of the shell;

wherein the shoe saddle is a mechanical structure;

wherein the shoe saddle attaches to the vertically oriented interior surfaces formed by the plurality of lateral faces of the shell;

wherein the shoe saddle receives the shoe that is to be cleaned;

wherein the shoe saddle holds the shoe in a fixed position within the pan structure of the shell.

12. The shoe shining device according to claim 11 wherein the lid further comprises a lid aperture;

wherein the lid aperture is an aperture that is formed through the lid;

wherein the lid aperture is formed through the lid such that the lid aperture is centered above the shoe mount;

wherein the shoe is placed on the shoe mount by inserting through the lid aperture.

13. The shoe shining device according to claim 12 wherein the first bevel gear rigidly attaches to the crank such that the rotation of the crank rotates the first bevel gear;

wherein the first bevel gear meshes with the second bevel gear such that the rotation of the first bevel gear rotates the second bevel gear;

wherein the first bevel gear meshes with the second bevel gear such that the axis of rotation of the first bevel gear is perpendicular to the axis of rotation of the second bevel gear;

wherein the second bevel gear rigidly attaches to the drive shaft such that the rotation of the second bevel gear rotates the drive shaft.

14. The shoe shining device according to claim 13 wherein the buffing band is a sheeting structure;

wherein the buffing band is shaped as a band;

wherein the buffing band is a webbing that is formed with a nap;

wherein the buffing band is an elastic structure;

wherein the napped surface of the buffing band rubs against the exterior surfaces of the upper structure of the shoe to generate a friction used to clean the exterior surfaces of the upper structure of the shoe.

15. The shoe shining device according to claim 14 wherein the transmission mechanism attaches to the drive shaft of the drive mechanism such that the axes of rotation of the transmission mechanism and the drive shaft are aligned;

wherein the transmission mechanism is a rotating structure;

wherein the transmission mechanism forms a looped path through guides the buffing band around the exterior surfaces of the upper structure of the shoe during the cleaning process;

wherein the transmission mechanism generates a continuous motion of the band through a loop formed by the transmission mechanism;

wherein the motion of the buffing band through the transmission mechanism generates the friction used to clean the exterior surfaces of the upper structure of the shoe.

* * * * *